US006401270B1

(12) United States Patent
Moore

(10) Patent No.: US 6,401,270 B1
(45) Date of Patent: Jun. 11, 2002

(54) TOILET APPARATUS

(76) Inventor: Garry Moore, 31 Percy Road, Ilford, Essex IG3 8SF (GB)

( * ) Notice: Subject to any disclaimer, the term of this patent is extended or adjusted under 35 U.S.C. 154(b) by 0 days.

(21) Appl. No.: 09/673,328

(22) PCT Filed: Apr. 13, 1999

(86) PCT No.: PCT/GB99/01116

§ 371 (c)(1),
(2), (4) Date: Dec. 13, 2000

(87) PCT Pub. No.: WO99/53149

PCT Pub. Date: Oct. 21, 1999

(30) Foreign Application Priority Data

Apr. 15, 1998 (GB) ..... 9807943

(51) Int. Cl.[7] ..... E03D 11/00

(52) U.S. Cl. ..... 4/431; 4/436; 4/432; 4/332; 4/334; 4/362; 4/369

(58) Field of Search ..... 4/431, 436, 432, 4/433, 434, 435, 368, 369, 313, 330, 332, 334, 362, 335

(56) References Cited

U.S. PATENT DOCUMENTS 3,566,415 A * 3/1971 Culp
3,698,019 A * 10/1972 Culp
3,720,962 A * 3/1973 Harrah
3,846,847 A * 11/1974 Tufts et al.
4,170,048 A * 10/1979 Anthony
4,215,681 A * 8/1980 Zalkin et al.
4,232,409 A * 11/1980 Van Pham
4,306,321 A 12/1981 Norlin ..... 1/1
4,376,314 A * 3/1983 Iwans
4,999,859 A * 3/1991 Bolze et al.
5,754,987 A * 5/1998 Johansson et al.
6,085,366 A * 7/2000 Pondelick et al.

FOREIGN PATENT DOCUMENTS

DE 196 23 331 A 12/1997
EP 0363012 A1 * 4/1990
FR 2 696 200 A 4/1994

* cited by examiner

*Primary Examiner*—Gregory L. Huson
*Assistant Examiner*—Khoa Huynh
(74) *Attorney, Agent, or Firm*—Lahive & Cockfield, LLP

(57) ABSTRACT

An embodiment provides a toilet having a toilet pan 11, an outlet pipe 78 for the contents of the pan, a closeable lid 21 on the pan forming with the pan a waste receptacle chamber, a seal 22 between the lid 21 and the pan 11, means 12 for introducing water into the chamber to wash the internal surface of the pan, and means 2 for subsequently increasing the air pressure in the chamber to force the contents of the pan through the outlet pipe.

20 Claims, 3 Drawing Sheets

TOILET APPARATUS

This invention relates to toilet apparatus, and in particular to such apparatus that uses little water in each flushing cycle.

A conventional toilet or water closet disposes of waste matter by hydraulic means alone by relying on a large enough volume of water to generate sufficient force to expel waste from the toilet pan. Many toilet systems exist which dispose of waste matter with a negative pneumatic pressure e.g. by drawing waste from the pan through an outlet pipe using various valves, pumps, vacuum chambers, transfer tanks and the like. Such systems do reduce water consumption but are generally difficult to manufacture, and are inconvenient to install, use and maintain.

U.S. Pat. No. 4,306,321 discloses a water closet for boats and caravans in which a sealed chamber, which includes the toilet pan, is pressurized to discharge the contents of the pan through a discharge valve into a holding tank, the chamber being subsequently pressurised again to discharge flushing water through the outlet valve to clean the valve. DE-A-19 623 331 and FR-A-2 696 200 both provide flushing water under pressure to a sealed pan/chamber to flush the contents of the pan through an outlet pipe, but make no provision for increasing the pressure in the chamber.

It is an object of the present invention to obviate or mitigate these difficulties by providing toilet apparatus which uses a positive pressure to discharge waste matter from the pan to an outlet pipe thus reducing water consumption. Such apparatus has the additional advantage that as the outlet pipe is unobstructed by valves or other equipment the toilet can also be used in a conventional way.

The present invention is toilet apparatus comprising a toilet pan, an outlet pipe for the contents of the pan a closeable lid on the pan forming with the pan a waste receptacle chamber, a seal between the lid and the pan, means for introducing water into the chamber to wash the internal surface of the pan, and means for subsequently increasing the air pressure in the chamber to force the contents of the pan through the outlet pipe.

Preferably, means are provided to pressurise the water introduced to wash the internal surface of the pan.

The lid may be provided with a locking mechanism for securing the lid in its closed position.

A locking sensor may be associated with the locking mechanism to detect locking of the lid and initiate operation of the apparatus.

In a preferred embodiment of the invention, the outlet pipe is formed with an S-bend water trap.

The means for increasing the air pressure in the chamber may include an air displacement unit connected to the chamber and, preferably also to the water cistern. The unit may comprise a piston movable in a cylinder. The piston moving in the cylinder in one stroke displaces a volume of air sufficient to provide the pressure in the chamber required to expel the contents of the pan. The piston may be double acting, the other stroke of the piston providing the air to pressurise the cistern and thus the water washing the internal surface of the pan before the contents of the pan are expelled.

The pan is provided with inlets for the water for washing its surface, these inlets being located at the top of the pan and being connected to the cistern by means which prevent the escape of air from the chamber.

Preferably, a cistern is connected to the pan by two pipes each incorporating siphon. One pipe is normally closed but may be opened manually to actuate the siphon, while the other pipe is open and may act as an overflow outlet. The cistern is provided with an aperture sufficient to relay pneumatic pressure and is connected to the air displacement unit. When the air displacement unit is activated, the displaced air pressurises the cistern and, all vents and pipes to the exterior being closed, the water in the cistern is forced through the open siphon and into the pan. By venting the overflow pipe when the water level falls to a predetermined level, the pressure in the cistern can be released while allowing continued siphonic flow from the cistern to the pan.

Operation of the air displacement unit may be triggered by the locking of the lid, the locking action being detected by a sensor.

The toilet apparatus may be fitted with a tipping/holding/siphon tank which may be pneumatically actuated/emptied.

An embodiment of the present invention will now be described, by way of example, with reference to the accompanying drawings, in which.

Figure 1:
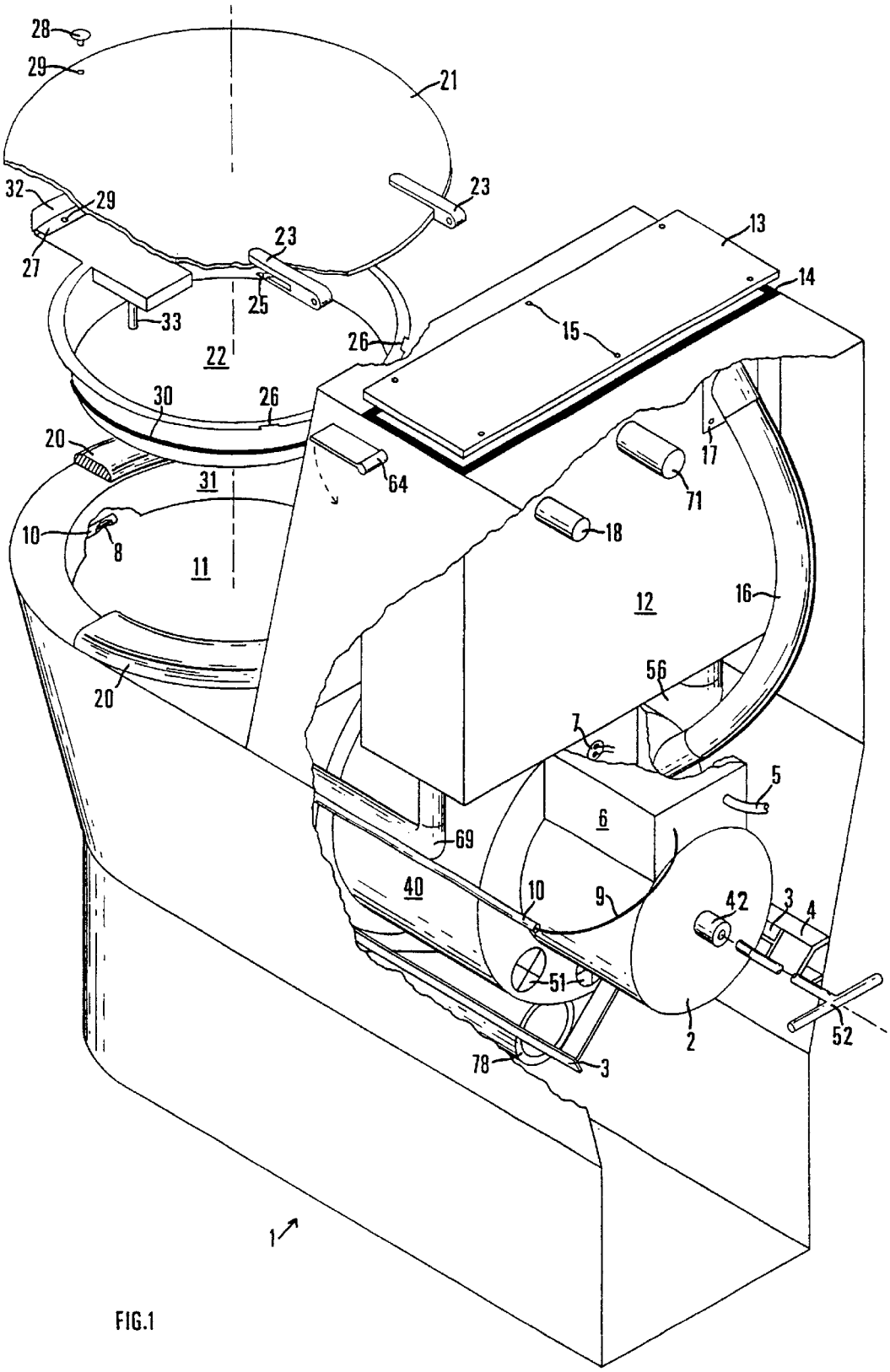
FIG. 1 is a partially cut away perspective view of toilet apparatus according to the present invention.

Referring now to the drawings, FIG. 1 shows the complete toilet apparatus generally indicated at 1. An air displacement unit 2 is shown installed on runners 3 secured to chassis guides 4 by fasteners (not illustrated) thus enabling the unit 2 to be easily withdrawn and installed as required. A power supply 5 enters a control box 6 which contains a proximity sensor 7 and control apparatus (not illustrated), and is connected to a second proximity sensor 8 by a cable 9. The cable 9 passes into a guide tube 10 which positions the sensor 8 inside the pan 11 of the toilet close to a locking bolt 34 as will be later described.

A cistern 12 has a lid 13 secured on a seal 14 by bolts passing through holes 15. An air hose 16 connects the air displacement unit 2 to the cistern 12 through a connector 17, thus enabling the cistern to be pressurised. A float valve inlet 18 is connected to a suitable water supply, and an overflow/vent pipe is shown at 71.

The pan 11 has a seat 20, a lid 21 and a removable lid seal/locking assembly 22. The lid 21 is provided with hinge brackets 23 and is raised and lowered around chassis outriggers 24 (FIG. 2) as will be explained later. Hinge brackets 23 have a rebate 25 sufficient to receive the seal/locking assembly lip at guide points 26. The seal/locking assembly 22 is further provided with a hook 27 thus enabling it to be slid under the lid 21 and secured by a peg 28 in holes 29, while simultaneously engaging the lip guide points 26 in the hinge bracket rebates 25. The lip seal 30 is fixed to the locking assembly 22 and makes an air tight seal with the rim 31 of the pan 11 when the lid is closed. A locking assembly handle 32 actuates the locking mechanism with a pull/push action through internal cams (not illustrated) which turn a shaft 33 thus relaying the movement to a locking bolt 34 (FIG. 2).

It will be appreciated that with such an arrangement a conventional toilet lid can be converted to a sealable, locking lid. The locking bolt 34 is provided with a magnetic tip 35 which enables the bolt to activate the sensor 8 when in the locking position. The locking action of the lid also initiates a flushing cycle by actuating the air displacement unit 2.

Figure 2:
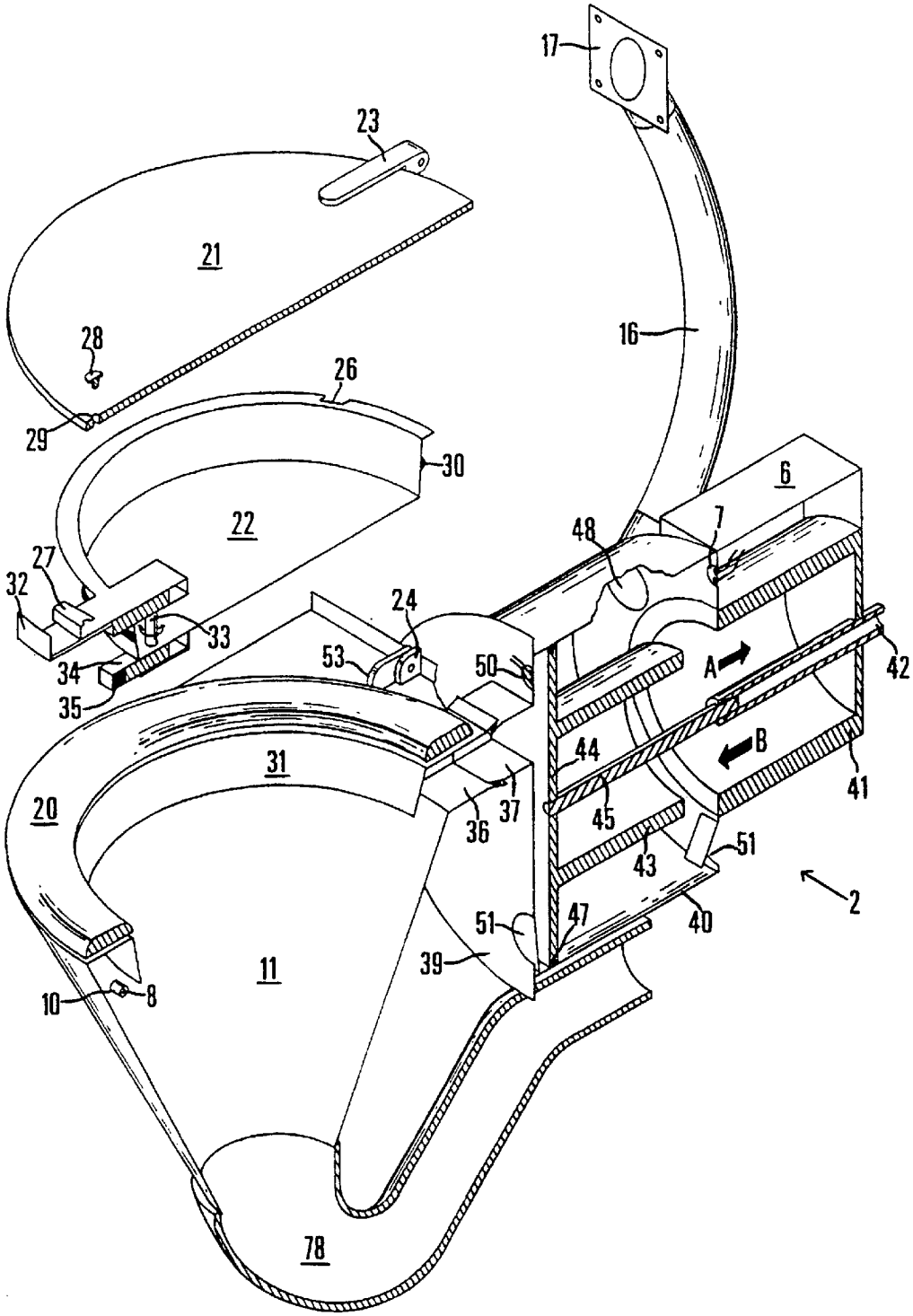
FIG. 2 is a perspective view in cross-section of the chamber and air displacement unit of FIG. 1.

FIG. 2 shows the air displacement unit 2 and its connection to the pan 11 through connectors 36 and 37 which are a male and female tapered fit and have between them a seal to form an air tight connection. It will be appreciated that, with such an arrangement, as the unit.2 is slid into position on the chassis guides 4, the connectors are automatically aligned to form an air tight connection capable of relaying air under pressure from the unit 2 to the pan.

The air displacement unit 2 consists of an end plate 39 fastened to a cylindrical housing or cylinder 40 in which is located a fixed electromagnet 41 around a central guide tube 42. A second electromagnet 43 is fixed to a piston 44 and has a central guide rod 4S forming an air tight fit in the guide tube 42. The piston is provided with a pneumatic seal 47 and is free to travel along cylinder 40. In FIG. 2, the unit 2 is shown in its rest position.

It will be appreciated that when the polarities of the electromagnets 41 and 43 are such that they are mutually attracted, the piston 44 is drawn along the cylinder 40 in the direction of the arrow A, thus displacing air in the cylinder 40 and forcing it through an aperture 48 and through the hose 16 into the cistern 12. Once the piston has reached the end of its travel, the proximity sensor 7 detects this and changes the polarity of one of the electromagnets 41 and 43 so that they now repel each other. The piston 44 is then driven back along the cylinder 40 in the direction of the arrow B thus again displacing the air in the cylinder 40. This displaced air is forced through connectors 36 and 37 and into the sealed pan chamber. Once the piston 44 has reached the end of its travel a proximity sensor 50 detects this and causes the electromagnets 41 and 43 to be deenergised. The air displacement unit 2 is reset once the sensor 8 senses that the lid 21 has been opened. Air vents 51 are of flap-valve type and allow an inward flow of air to the cylinder 40 sufficient to prevent a vacuum developing behind the piston 44. The piston 44 may be driven manually by a handle 52 (FIG. 1) which is connected to the guide rod 45.

The seat hinge brackets 53 and lid hinge brackets 23 are connected to the chassis outriggers 24 by hinge pins and are free to pivot around them.

Figure 3:
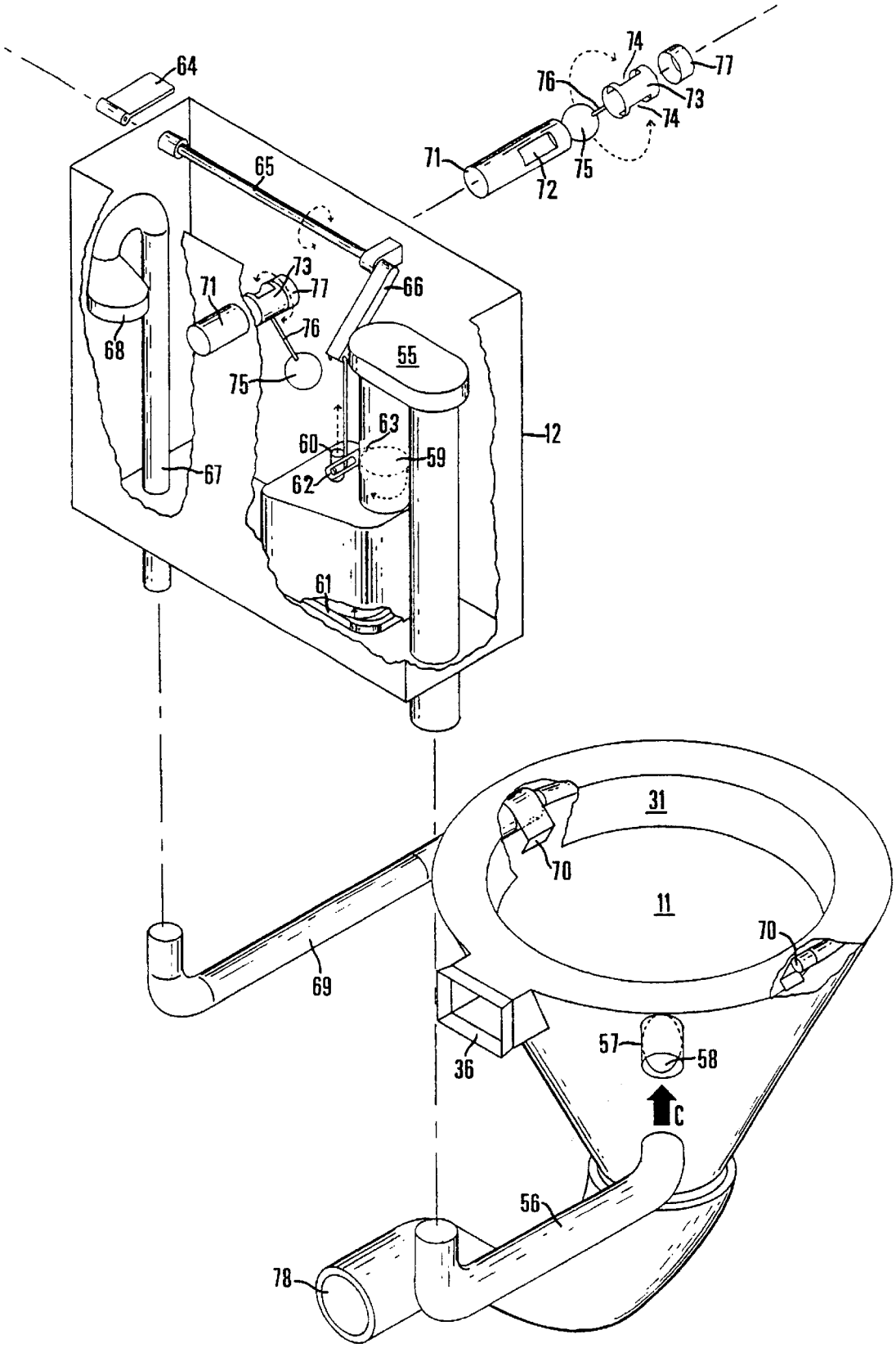
FIG. 3 is a partially cut away perspective view of the cistern and pan used in FIG. 1.

FIG. 3 shows the cistern 12. A primary siphon 55 connects to the water pipe 56 which in turn connects to the pan 11 at the connector 57. The connector 57 is provided with a flap valve 58 which allows the flow of air and water only in the direction of the arrow C. This allows the cistern to discharge into the pan while blocking the escape of air from the pan 11. The primary siphon 55 is provided with a flap valve 59 for preventing the flow of water from the cistern 12. Water flow through the siphon 55 is achieved by lifting the plunger 60 which is connected to a siphon actuator 61 and a flap-valve lever 62 which is pivoted on a fulcrum 63.

It will be appreciated that with such an arrangement the siphon is normally blocked, but by lifting the plunger 60 the flap valve is opened by lever 62 and siphonic flow is started by the actuator 61 thus depositing the contents of the cistern into the pan 11 in a sufficient quantity to flush the pan. Conveniently, means to lift the plunger 60 is provided by the handle 64, connecting rod 65 and lever 66.

A secondary siphon 67 consists of an open tube provided with a bell mouth 68 to facilitate effective breaking of its siphon. The siphon 67 connects to a water pipe 69 which enters the pan 11 and distributes water over the surface of the pan through nozzles 70 located under the rim of the pan 11, thus providing an efficient spray pattern for washing the pan. With such an arrangement an open overflow route to the pan 11 is always provided. The nozzles 70 and pipe 69 may be fitted with valves for inhibiting the escape of air from the pan 11.

An overflow pipe 71 connects to the cistern 12 and is provided with an additional aperture around its circumference 72. A sleeve is connected to a float 75 by a rod 76 and fits over the overflow pipe 71 where it is free to swivel upon it. Two apertures 74 are provided such that as sleeve 73 turns aperture 72 may be exposed or obscured by sleeve apertures 74. An end cap 77 is an air tight fit over pipe 71 and retains the sleeve 73 in place. Thus, as the water level in the cistern changes the float 75 rises and falls accordingly thus turning the sleeve 73 on the pipe 71 which opens and closes cistern vent through apertures 72 and 74.

It will be appreciated that with such an arrangement waste is deposited into the pan 11 and the lid is closed and locked. The locking action of the lid 22 triggers the sensor 8 to activate the air displacement unit 2 causing the piston to be driven forward to force air into cistern through the hose 16. As the cistern water level is high, the pipe aperture 72 is obscured and there is no vent for displaced air. Consequently, water is forced through the open secondary siphon 67 and into the pan 11 where the nozzles 70 provide a spray pattern to wash the surface of the pan. As the cistern water level drops, the float 75 drops thus exposing the aperture 72 whereupon pressurised air is vented via aperture 74. Air resistance to the piston 44 drops and the piston quickly reaches the end of its travel. Water is still able to flow through the open siphon at a reduced rate due to gravity.

The direction of piston 44 is now reversed and the air inside the sealed pan chamber is pressurised, whereupon waste is forced through the outlet pipe 78. The piston 44 reaches the end of its travel and the flushing cycle ends. However the siphon 67 is still active and a quantity of water sufficient to replenish the water trap seal 78 is deposited into the pan 11 before the water level drops to the level of the bell mouth 68 and the siphon is broken. The cistern water level is then replenished via the float valve and the float 75 rises thus closing the vent 72.

In the event of inlet valve failure, the float 75 rises thus aligning the pipe aperture 72 with the second aperture 74 of the sleeve, allowing water to drain away. Alternatively, rising water may drain away through the open siphon to the pan 11. Other embodiments of the invention may provide an overflow via the cistern hose 16 and air displacement equipment.

It will be apparent that the toilet apparatus may be used in a conventional manual hydraulic flush mode by using the handle 64.

While the air displacement unit as described is operated electrically or manually, it could be modified to operate mechanically, hydraulically or pneumatically.

In a further modification of the embodiment described, the cistern is not pressurised, and the piston may be either single acting, in which case the return stroke serves merely to reset the unit, or double acting in which case the return stroke serves to pressurise the chamber in a second flushing cycle.

The air displacement unit may take other forms including a diaphragm an air pump or a reservoir of compressed air.

In a further modification of the embodiment, the air displacement unit takes the form of a compressor, diaphragm or pressurised gas container or reservoir.

What is claimed is:

1. Toilet apparatus comprising a toilet pan, an outlet pipe adapted to receive contents of the pan, a closeable lid on the pan forming with the pan a waste receptacle chamber, a seal between the lid and the pan, means for introducing water into the chamber to wash an internal surface of the pan, means for increasing air pressure in the chamber to force the contents of the pan through the outlet pipe, a water trap seal disposed in the outlet pipe, and means for supplying water to replenish the water in the water trap after the contents of the pan have been expelled and compressed air is no longer being supplied to the chamber.

2. Apparatus as claimed in claim 1, wherein the means for increasing the air pressure in the chamber comprises an air displacement unit.

3. Apparatus as claimed in claim 2, wherein the air displacement unit comprises a piston in a cylinder.

4. Apparatus as claimed in claim 3, wherein the piston is actuable electromagnetically.

5. Apparatus as claimed in claim 3, wherein the air displacement unit has an outlet at one end of the cylinder connected to the chamber whereby movement of the piston towards that end of the cylinder increases the air pressure in the chamber.

6. Apparatus as claimed in claim 5, wherein the air displacement unit has a second outlet at a second end of the cylinder, the second outlet also being connected with the chamber.

7. Apparatus as claimed in claim 3, wherein the piston in one stroke displaces a volume of air sufficient to expel the contents of the pan.

8. Apparatus as claimed in claim 2, wherein the means for introducing water into the chamber includes the air displacement unit.

9. Apparatus as claimed in claim 8, further comprising a cistern for holding flushing water.

10. Apparatus as claimed in claim 9, wherein the air displacement unit comprises a piston in a cylinder, and an outlet at an end of the cylinder whereby movement of the piston towards the end pressurizes the cistern and forces water from the cistern to the pan.

11. Apparatus as claimed in claim 9, wherein the cistern includes a siphon for delivering water to the pan to wash the internal surface of the pan.

12. Apparatus as claimed in claim 11, wherein operation of the air displacement unit forces water through the/siphon to the pan.

13. Apparatus as claimed in claim 9, further comprising a float valve in the cistern, the float valve being responsive to a level of water in the cistern to release a pressure in the cistern at a predetermined water level.

14. Apparatus as claimed in claim 11, wherein the siphon continues to deliver water to the pan after a pressure in the cistern has been released.

15. Apparatus as claimed in claim 1, wherein the lid is provided with a locking mechanism for securing the lid in a closed position.

16. Apparatus as claimed in claim 15, wherein the means for supplying air includes an air displacement unit, and wherein the locking mechanism includes a locking sensor to detect locking of the lid and initiate operation of the air displacement unit.

17. Apparatus as claimed in claim 16, wherein the air displacement unit includes a piston in a cylinder, and the sensor initiates movement of the piston.

18. Apparatus as claimed in claim 17, further comprising a piston sensor provided at an end of the cylinder to detect the piston at that end and initiate movement of the piston towards an other end.

19. Apparatus as claimed in claim 1, wherein the lid and the seal are a removable unit.

20. Apparatus as claimed in claim 1, further comprising means for supplying to the chamber a volume of water sufficient to flush the contents of the pan through the outlet pipe without increasing pressure in the chamber.

* * * * *